United States Patent [19]

Ericsson

[11] Patent Number: 4,492,163

[45] Date of Patent: Jan. 8, 1985

[54] SILK-SCREEN PRINTING MACHINE HAVING AN ENDLESS CONVEYOR AND REGISTRATION FOR THE PRINTED ON MATERIAL

[76] Inventor: Sylve J. D. Ericsson, Storvretsvägen 48, 147 00 Tumba, Sweden

[21] Appl. No.: 125,197

[22] Filed: Feb. 27, 1980

[30] Foreign Application Priority Data

Feb. 28, 1979 [SE] Sweden ..... 7901808

[51] Int. Cl.[3] ..... B41L 13/02

[52] U.S. Cl. ..... 101/126; 101/115; 101/233; 101/DIG. 12; 226/33; 271/266

[58] Field of Search ..... 101/91, 115, 117, 118, 101/126, 233; 271/265–266; 226/33

[56] References Cited

U.S. PATENT DOCUMENTS

| | | | |
|---|---|---|---|
| 3,231,266 | 1/1966 | Hu | 271/35 |
| 3,638,564 | 2/1972 | Prange | 101/126 X |
| 4,015,701 | 4/1977 | Templeton | 271/266 |
| 4,031,824 | 6/1977 | Bubley | 101/126 |
| 4,173,928 | 11/1979 | Mitter | 101/126 |

*Primary Examiner*—Clyde I. Coughenour
*Assistant Examiner*—A. J. Heinz
*Attorney, Agent, or Firm*—Burns, Doane, Swecker & Mathis

[57] ABSTRACT

A silk-screen printing machine, preferably of the kind which uses an endless conveyor belt as a material conveying means, said conveyor belt being driven by a drive source in a manner such that the belt can be stopped in a first position for registering or aligning the material to be printed upon, and then to convey the material to a printing position where a print corresponding to a stencil pattern is applied to the material. A sensing device for sensing the movement of the material from the registering position to the printing position with an accuracy less than 0.5 millimeters is connected to a counter. The counter includes an arrangement which at a predetermined setting substantially corresponding to the conveyed distance between the first and second positions generates a signal adapted to actuate a drive for stopping the conveyor when the material is in the second position. The drive transports the material from the first to the second position over a period of rapid acceleration, substantially constant velocity and rapid deceleration. The counter controls the drive during a period of very low speed after the rapid deceleration and stops the drive at the predetermined setting.

6 Claims, 10 Drawing Figures

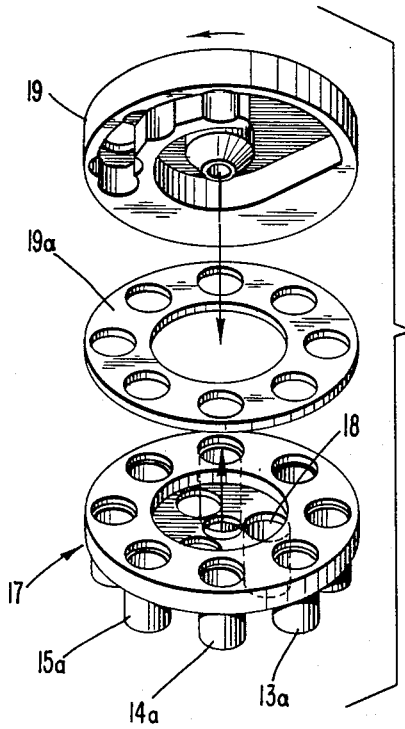
Fig. 4
Fig. 7
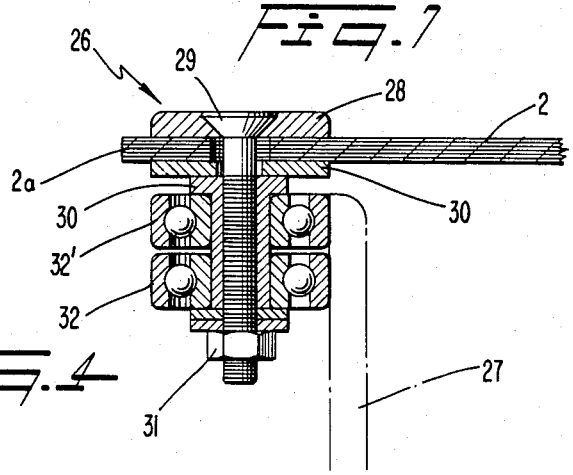
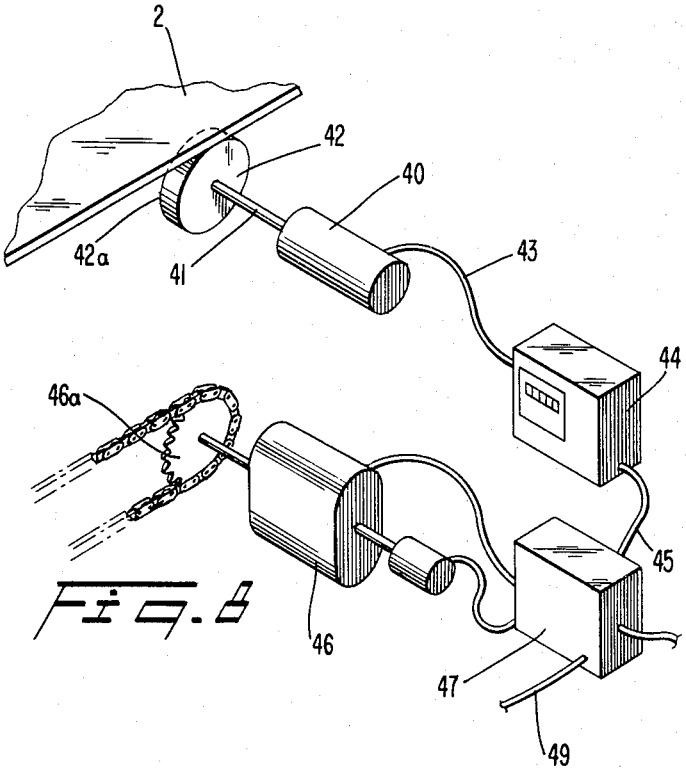
Fig. 8
Fig. 9
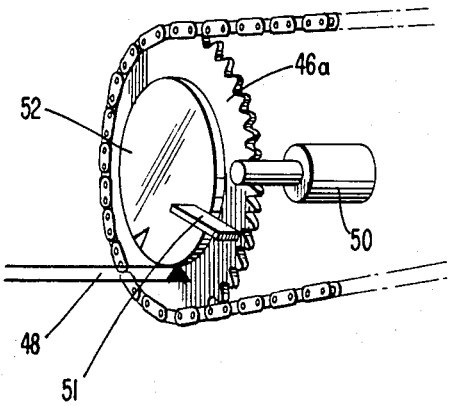
Fig. 10
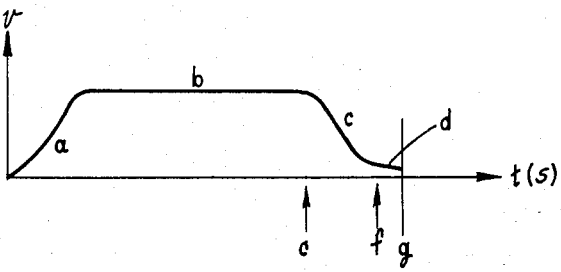

SILK-SCREEN PRINTING MACHINE HAVING AN ENDLESS CONVEYOR AND REGISTRATION FOR THE PRINTED ON MATERIAL

TECHNICAL FIELD

The present invention relates to a silk-screen printer, preferably of the kind having an endless conveyor as the material conveying means. The conveyor is driven by a drive source, normally a d.c. motor so constructed that it can stop in a first position for registering the material to be printed upon, and thereafter convey the material to a printing position, in which a print corresponding to the pattern of a stencil is applied to the material.

Normally, the conveyor is supported and moved over a support surface placed beneath the conveyor, such that the conveyor rests against a planar support surface, both in the registering position of the material and in the printing position thereof, i.e. the position in which a print is applied to the material.

BACKGROUND ART

A number of differing silk-screen printers of the aforementioned kind, using an endless conveyor as the material conveyor, are known to the art. In this respect reference can be made to Swedish Patent Specification No. 383,487, which describes a rotary printing machine for band-like material, particularly woven material, said machine comprising an endless support belt which is driven with a drive disc and mechanical transmission means for a plurality of printing rollers. In addition, there is provided a synchronizing means by which the movement of the support belt is synchronized with the movement of the printing roller during operation. Means are also provided for lifting the printing rollers away from the support belt.

The illustrated and described synchronizing means includes a rotary pulse generator and is driven by a sensing wheel lying against the support belt. The pulse generator is arranged to produce pulses corresponding to the linear velocity of the support belt. An amplifier and pulse converter, for amplifying and converting the pulses produced by said generator, are used to drive a stepping motor and a four-path control valve, to adjust oil flow. This oil flow shall be proportional to the movement of a female screw or nutscrew, said screw being driven by the stepping motor via a reduction gearing.

DISCLOSURE OF THE INVENTION

Technical Problem

Silk-screen printing machines of the kind having an endless conveyor belt as the means for conveying material, and in which the conveyor belt is driven by a drive source so constructed that the belt can be stopped in a first position for registering or aligning the material to be printed upon, and thereafter conveys the material to a printing position and to stop in said printing position so that a print corresponding exactly to the pattern of a stencil can be applied to said material in said printing position are encumbered with a serious disadvantage.

For example, after the material has been registered or aligned in the registering position on the conveyor belt, it must be possible to move the material on the conveyor belt to the printing position and be stopped there without requiring further alignment in the precise printing position. It can be mentioned here that the distance through which the material is conveyed from the registering position to the printing position may vary, although it is not unusual for this distance to exceed 10 meters, and it should be understood that the material must be placed in the printing position with an accuracy of not less then 0.5 mm, preferably 0.1 mm or less, in order that the stencil pattern can be transferred to the material with the highest possible degree of accuracy, and be exactly related to said material. The problem is amplified by the fact that the material must be moved from the registering position to the printing position very rapidly.

Another problem which has been found difficult to overcome in silk-screen printing machines in general, and in silk-screen printing machines of the afore described kind in particular, is one in which when printing a very thin material, it is difficult to align or register the material in the registering position. In the case of extremely thin, or brittle materials it has been found that when placed on a conveyor belt, the friction acting between said material and said belt, or the tendency of the material to adhere to said belt renders it difficult to align the material in the registering position, solely by applying a force to the edge of said material with the registering means used herefore.

The first mentioned problem is mainly due to the fact that the two ends of the belt must be joined by means of a splice or seam. It has been found practically impossible to produce a seam of the same homogenity as the remainder of the conveyor belt. The endless conveyor belt must run over a plurality of drive rollers, end rollers and linking rollers, and during its movement the belt curves practically exclusively in one direction. As the seam passes said rollers, the radius of the curve in the belt will vary, depending upon whether the homogeneous belt passes the rollers or whether the seam passes said rollers. This is particularly true of the drive rollers and end rollers.

The rollers, and in particular the drive rollers and end rollers may have considerable diameters, in the order of magnitude of 200 mm, and it will be understood from this that a relatively small difference in the radius of curvature of the conveyor belt will result in considerable error when registering the material in the printing position, when the distance moved by the belt is calculated from the registering position to the printing position, as with previously known methods. This, of course, applies when the distance travelled by the conveyor belt is measured via the drive rollers or end rollers. If it is assumed that the change in diameter is of the order of magnitude of 0.1 mm, the error in registration of the conveyor belt will be of the order of magnitude of 0.3 mm for each roller at half winding.

It is also difficult in silk-screen printing machines of the afore described kind to register the material in the printing position, since the printing position is dependent upon two mutually different parameters, namely that the conveyor belt moves through the exact distance between the registering or aligning position of the material and its printing position, where it must be possible to estimate said distance very exactly and equally between the various material conveyor means, and that the conveying belt must follow exactly the center line for the conveyor belt in the conveying direction each time material is conveyed from the registering position to the printing position.

With respect to the problem of being able to register or align a thin material, specially a thin and brittle material, exactly in the registering position, it has been found that when attempting to align extremely thin sheets of glass, the glass itself has cracked when applying the registering means to the edge surfaces of said glass sheet. It is also extremely difficult to move the glass sheet along the conveyor belt, owing to the adhesion forces or frictional forces existing between the belt and the sheet.

A further problem arises from the fact that the glass sheet is moved to the registering position in the conveying direction of the conveyor belt at a speed which exceeds the speed of said belt, which means that the leading edge of the glass sheet strikes against the forward registering means, requiring the kinetic energy stored in the glass sheet to be absorbed during movement of said sheet to the registering position. Hitherto, the glass sheet has often cracked or broken when striking said forward registering means.

Solution

In a silk-screen printing machine having an endless conveyor belt as the means for conveying said material, and in which the conveyor belt is driven by a drive source in a manner such that said belt can be stopped in a first position for registering or aligning the material to be printed and then caused to move the material to a printing position in which a print corresponding to the pattern of a stencil can be applied to said material, said first mentioned problem is solved by the fact that movement of the conveyor belt for moving the material from the registering position to the printing position is detected by a movement detecting means having a resolution of less than 0.5 mm, preferably 0.1 mm or less than 0.1 mm. The detecting means is coupled to a counter which at a pre-determined setting, corresponding to the conveying distance of the conveyor belt from the first position to the second position, generates an activating signal which instructs the drive source to stop the conveyor belt just as the material takes a second position.

Transportation of the material from the registering position to the printing position is effected with a strong acceleration, a constant or substantially constant velocity and a rapid deceleration, and the final registering of the material is effected at a very low speed.

The aforementioned second problem is solved by directing a fluid onto the under surface of the material in the first registering position. This fluid lessens the frictional forces acting between the material and its support surface, which may be a printing table or a conveyor belt, thereby facilitating movement of the material along said support surface to a registering position. Subsequent to the material taking said registering position, the under surface of said material is subjected to a sub-pressure, thereby to increase the friction between said material and said support surface. This sub-pressure should be maintained throughout the total distance moved by the material to the printing position.

Advantages

By measuring the distance moved by the material from the registering position to the printing position by means of a detecting means, which has a resolution of 0.1 mm, it is possible to register the material accurately and precisely in the printing position. By coupling the movement detecting means to a counter, which can be set with an accuracy corresponding to the detecting means in dependence upon the desired distance of movement, it is possible, if so desired, to change said distance between various materials in a simple manner. It is also possible with the aid of said setable counter, to compensate for any delays between the stop signal to the drive source and the stopping of the drive source and the belt when the material is to take the printing position.

With respect to the method of registering or aligning the material in the registering position, in accordance with the invention, it has been found that the decrease in friction between the material and the support surface enables very thin and brittle materials to be registered or aligned in a simple manner without cracking or damaging said material.

By arranging resilient and yielding stop means and registering means, against which the leading edge of the material is arranged to strike, it has been found possible to reduce and absorb the kinetic energy stored in the material, and thereby obtain the desired degree of accuracy in the registering of said material.

BRIEF DESCRIPTION OF THE DRAWINGS

A preferred embodiment of the invention will now be described with reference to the accompanying drawings, in which FIG. 4 is an exploded view of a valve arranged to produce stepwise a sub-pressure in sections formed in the printing table, FIG. 7 illustrates one of a plurality of means attached to the edge surface of the conveyor belt, FIG. 8 is a simplified view of the guide used to exactly define the conveying distance of the material from the registering position to printing position, FIG. 9 illustrates an arrangement for guiding a cam disc actuable by the drive source, and FIG. 10 is a speed-time diagram for the conveyor belt during its movement when conveying material from the registering position to the printing position.

DESCRIPTION OF THE PREFERRED EMBODIMENT

Although certain parts of the present invention are not directly dependent upon the illustrated embodiment, the various characteristics of the invention will be more specifically described, however, with reference to a silk-screen printing machine provided with an endless conveyor belt which serves as a support surface for the material to be printed upon.

Figure 1:
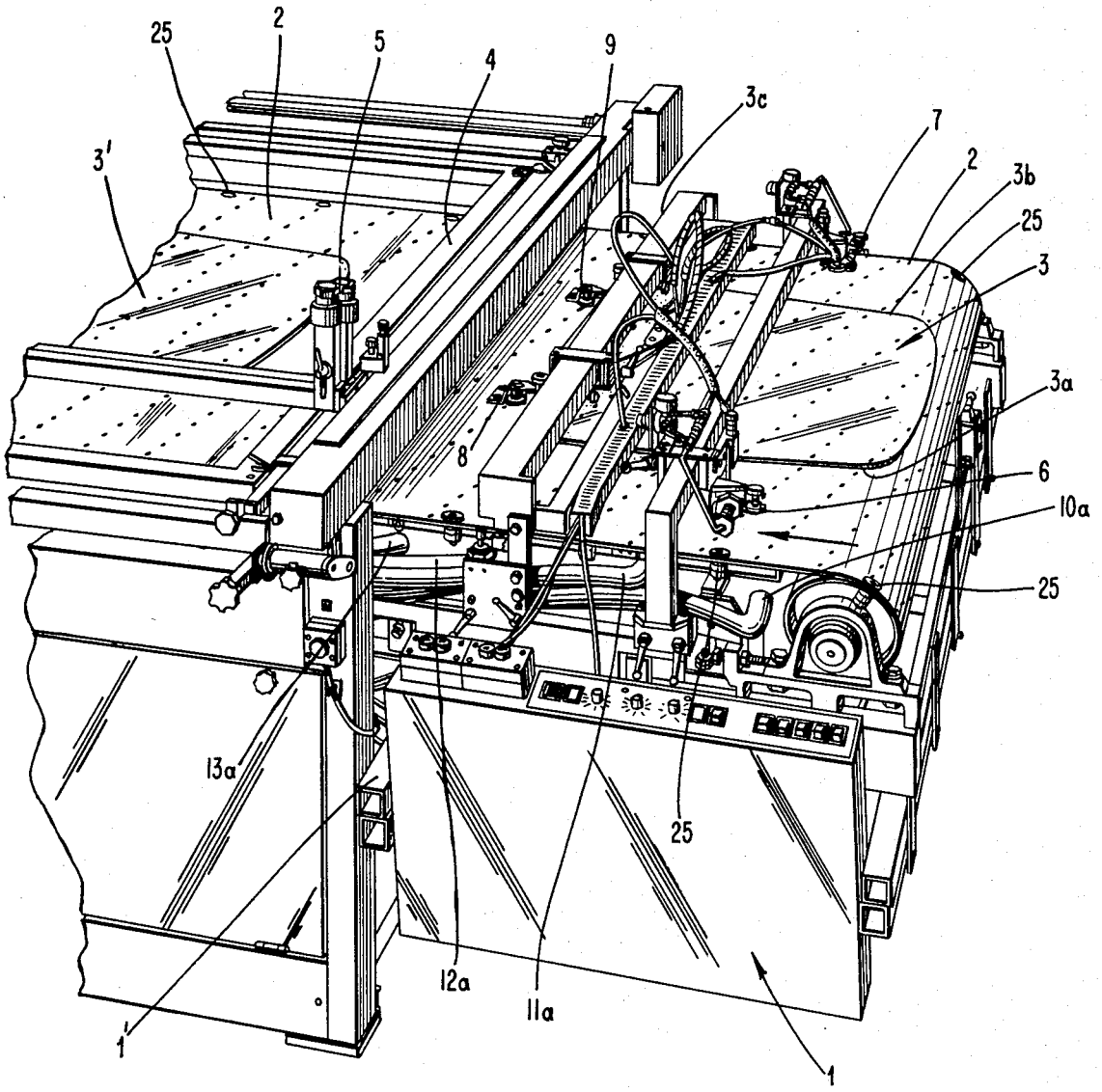
FIG. 1 is a perspective view of a silk-screen printing machine having a first registering position for material to be printed upon.

Thus, the silk-screen printing machine illustrated in FIG. 1 is identified generally by the reference 1. The mode of operation of a silk-screen printing machine will be obvious to all those skilled in this art, and hence the following description will be restricted to those parts of the machine which are necessary to provide an understanding of the significant characteristics of the present invention. The endless conveyor belt used as a support surface is referenced 2, said conveyor belt being used as a material conveying means. Resting on the conveyor belt 2 is a first piece of material 3 to be printed upon, said material having the form of a thin glass sheet, which sheet shall be aligned or registered, i.e. moved into an exact position relative to the frame 1' of the printing machine.

The conveyor belt 2 is driven by a drive source (not shown in FIG. 1) comprising a direct-current motor.

This motor is controlled via a four-square thyristor control in a manner such that the conveyor belt can be stopped in a first position for registering the material 3 to be printed upon in the position shown in FIG. 1, and then to convey the material 3 resting on the belt 2 to the printing position, in which a second piece of material 3' is shown. A print corresponding to the stencil pattern shall be applied to said material in the printing position. For the sake of clarity, the stencil is not shown in the Figure, although it can be mentioned that the stencil shall be stretched in a frame 4 in a manner known per se. Ink is applied to the upper side of the stencil by means of a squeegee arrangement 5, through holes formed in the stencil, whereby a print is applied to the material 3' in the printing position.

Figure 2:
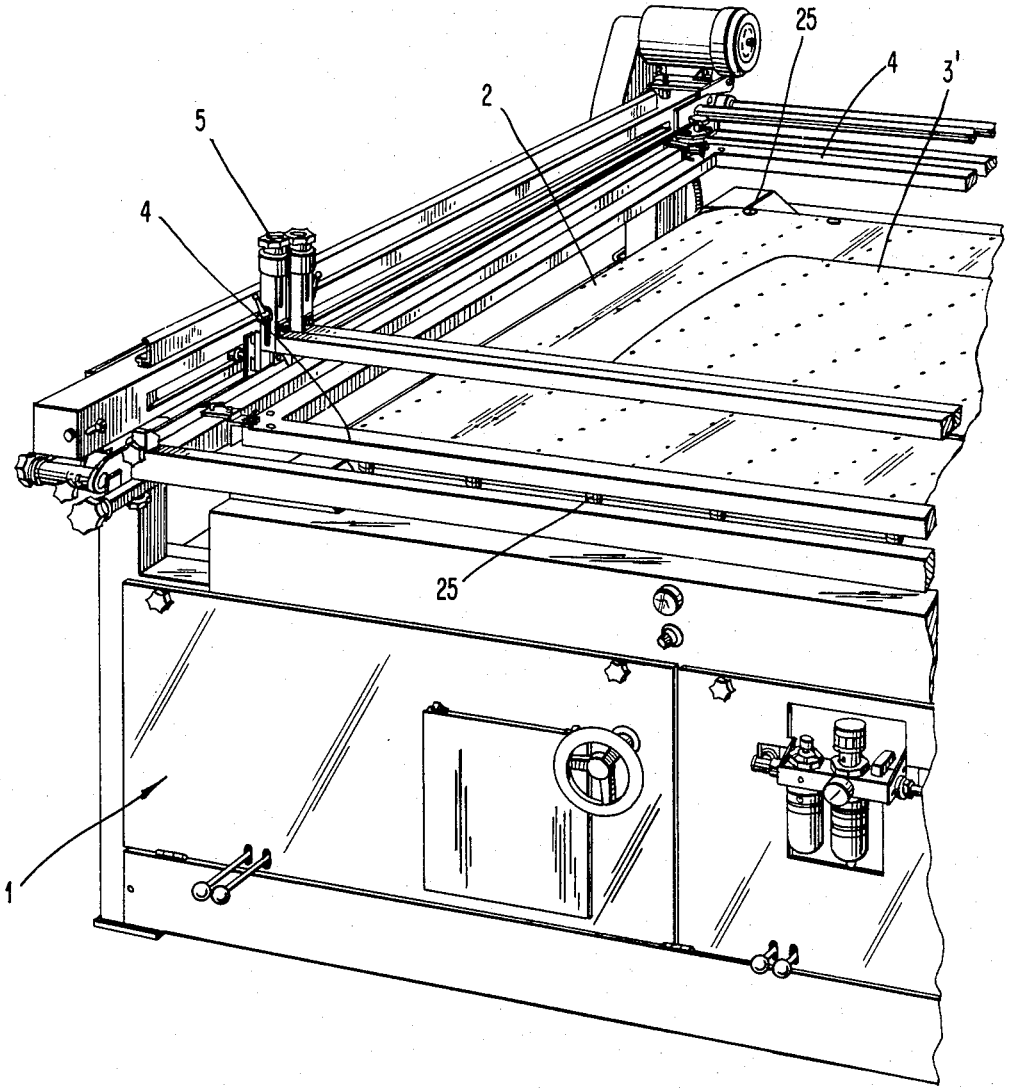
FIG. 2 illustrates the silk-screen printing machine according to FIG. 1, in which a second piece of material has taken the printing position.

It will be clear, since the stencil 4 is fixed relative to the frame of the printing machine, that the position of the material 3' is extremely important for obtaining an exactly related print, and hence it is also important that the distance travelled by the material from the position shown in FIG. 1 to the position for the material 3' shown in FIG. 2 can be exactly estimated (with a tolerance of only some tenth of a millimeter).

The material 3 in the first registering position shown in FIG. 1 is acted upon from beneath by a fluid in a manner such as to decrease the friction between the material and its support surface, said support surface having a form of the conveyor belt 2. Displacement of the material 3 by the registering means 6 engaging the side edge 3*a* of said material and the registering means 7 engaging the side edge 3*b* of said material, is greatly facilitated in this way. In addition to the aforementioned registering means, registering means 8, 9 are also provided for engaging the leading edge 3*c* of said material. The material 3 can now be displaced into an exact registering position by means of the registering means 6, 7, 8 and 9 with only negligible friction between said material 3 and the conveyor belt 2. The magnitude of the frictional force which shall exist between the material 3 and the conveyor belt 2, in order to obtain accurate registering of said material, is estimated in practice from material to material, by increasing or decreasing the amount of fluid applied to the bottom of said material.

Subsequent to registering said material 3, by means of the registering means 6, 7, 8 and 9, the friction acting between the material and the support surface or conveyor belt 2 shall be increased, this being effected by creating a sub-pressure beneath said material. This sub-pressure, or a similar sub-pressure, is active along the whole distance moved by the material 3 to the printing position shown in FIG. 2, and also during the actual printing process.

As before mentioned, the material support surface comprises the endless conveyor belt 2. This belt should be specially treated in a manner such as to remove all variations in thickness to the greatest possible extent.

Beneath the conveyor belt 2 there is located a support surface or so-called printing table, said printing table being divided into sections. Thus, the conveyor belt 2 runs over the whole of the printing table. The printing table is provided with a plurality of holes, as is also the conveyor belt.

Figure 3:
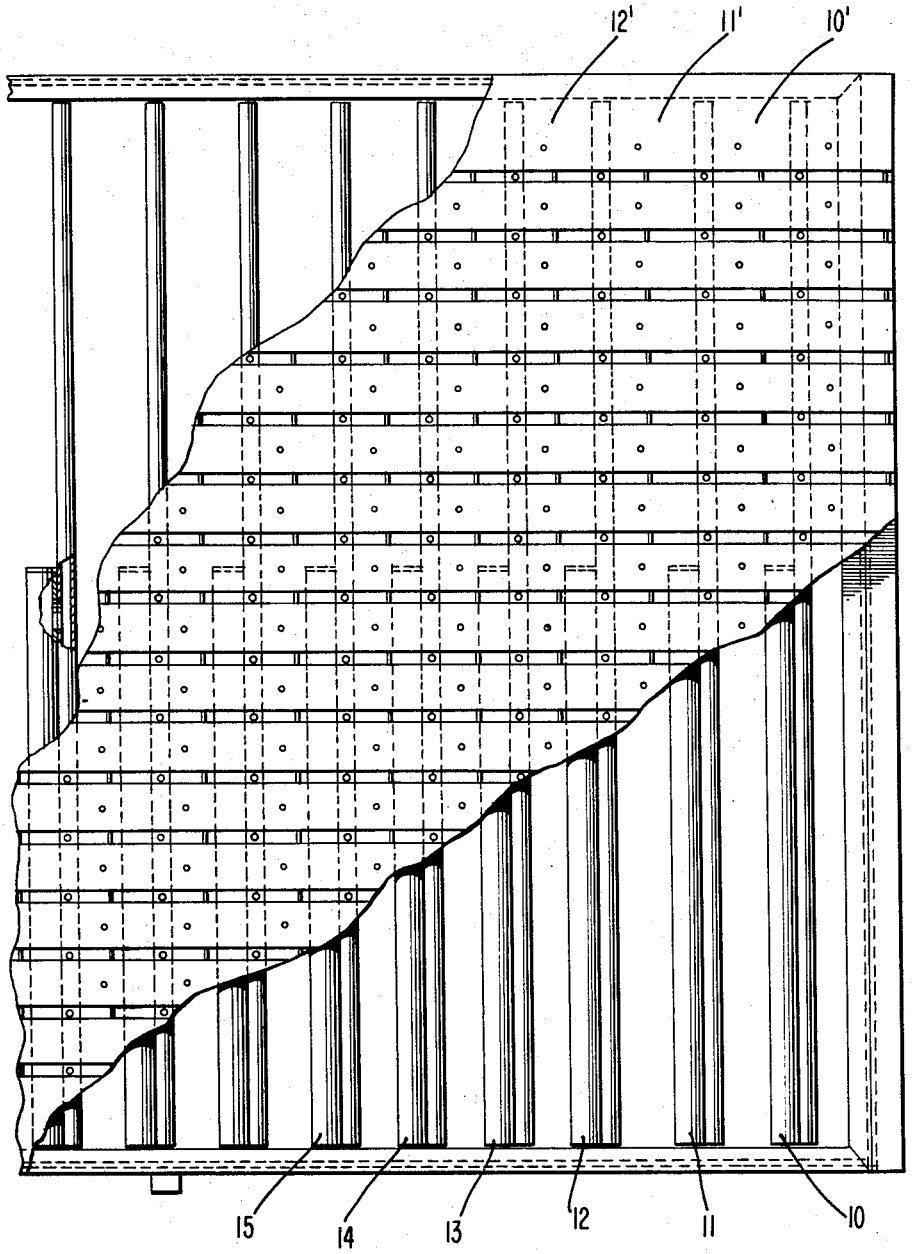
FIG. 3 is a partly sectional view of a support table placed beneath the endless conveyor belt.
Figure 5:
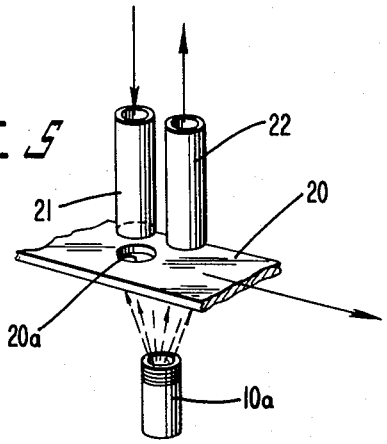
FIG. 5 illustrates schematically a valve intended for those sections in the printing table located beneath the material registering position, i.e. the position shown in FIG. 1.
Figure 6:
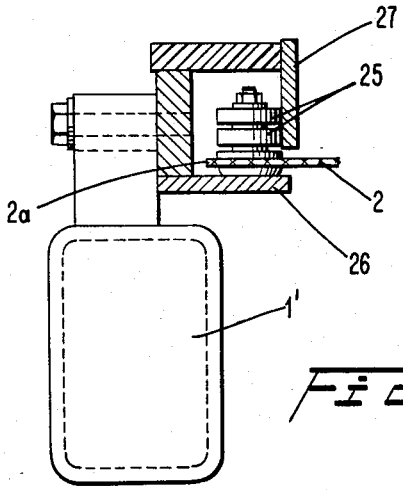
FIG. 6 illustrates in side view those measures taken for holding the conveyor belt exactly in its conveying direction.

The printing table is illustrated, partly in section, in FIG. 3. As will be seen from FIG. 3, the printing table is divided into a plurality of sections, each of said sections communicating with a pipe. Thus, the section 10' communicates with a pipe 10, the section 11' communicates with a pipe 11, the section 12' communicates with a pipe 12, etc. etc. The first three sections communicating with pipes 10, 11 and 12, are located beneath the material in FIG. 1. The pipe 10 co-operates with a hose 10*a*, the pipe 11 co-operates with a hose 11*a*, and the pipe 12 co-operates with a hose 12*a*. (c.f. FIG. 1). Each of the hoses 10*a*, 11*a*, 12*a* extends to a valve, which is shown only schematically in FIG. 5. FIG. 5 illustrates how the hose 10*a* can either be made to communicate, via a valve means 20, with a pipe 21 for fluid in the form of compressed air, or with a pipe 22 connected to a sub-pressure source. A control valve (not shown in the Figure) can be coupled to the pipe 21 or to the pipe 22.

When the valve seating 20 is set to the illustrated position, with its hole 20*a* in registry with the pipe 21, compressed air is supplied to the hose 10*a*, and also to the hoses 11*a* and 12*a*. In this way there is formed beneath the material 3 an air cushion which facilitates registration or alignment of the material in the aforedescribed manner. Subsequent to aligning the material, the valve 20 is adjusted so that the hole 20*a* registers with the pipe 22, thereby increasing the friction acting between the material 3 and the conveyor belt 2, the under surface of said material being subjected to a sub-pressure.

As the conveyor belt 2 moves the material 3 to the position illustrated in FIG. 2, the hoses of the sections 13, 14, 15 etc., of which hoses only one is shown in FIG. 1, namely the hose 13*a*, are successively coupled to the sub-pressure source as the material 3 is moved. This is effected through a valve illustrated in FIG. 4. Thus, the connection 18 of the valve 17 is connected to the sub-pressure source, and the valve body 19 is turned in the direction shown by the arrow in the Figure, meaning that the sub-pressure source is coupled successively to the sections 13, 14, 15 etc., until the material has taken the position illustrated in FIG. 2.

In this way, only those sections which are located immediately beneath the material in the registering position will be coupled to a first valve, shown in FIG. 5, which either causes the sections to be subjected to an over-pressure or to be subjected to a sub-pressure. The remaining sections of the printing table are coupled to a second valve, shown in FIG. 4, arranged to couple only those sections which are located beneath the material 3 during its transport over and along the printing table to the position shown in FIG. 2. It should be noted here that rotation of the valve body 19 relative to the stationary part 17 and the intermediate sealing 19*a* is effected in dependence upon movement of the conveyor belt 2, and that rotation of the valve body 19 can thus be effected from the drive source of the belt 2 via a transmission means.

When the material 3 reaches the registering position shown in FIG. 1, the leading edge 3*c* of said material shall be arranged to strike against and be registered by two registering means 8, 9, and by two side-registering means 6 and 7, and the piece of material 3 as a whole shall be moved to the registered position on a friction-reducing air cushion formed beneath said material. Subsequent to the material being aligned or registered, the first valve shown in FIG. 5 is activated and the section beneath said material is subjected to a sub-pressure.

Registering of the material 3 in the registering position shown in FIG. 1 is effected simultaneously with or somewhat prior to the printing of another piece of material 3' positioned precisely in the printing position shown in FIG. 2.

The material is conveyed from the registering position (shown in FIG. 1) to the printing position (shown in FIG. 2) during a period of rapid acceleration, a constant or substantially constant velocity, and a rapid deceleration, and finally a very low velocity. During the period of low velocity, the side-registering means 6 and 7 for aligning the side edges 3*a* and 3*b* of the material are activated, while the leading edge of the material abut the forward registering means 8 and 9, which cause the material to be registered before the conveyor belt 2 has stopped, causing the conveyor belt to slide under the material 3. The registering means 8 and 9 for aligning the leading edge 3*c* of the material are arranged to yield, thereby to absorb kinetic energy stored in the material 3 when the conveyor (not shown in the Figure) is rapidly moved in to the registering position. Registering of the material in the printing position is effected solely during the period of low conveying speed. As will be understood, the springs of the registering means 8 and 9 are of sufficient strength to hold the material 3 in the registered position, even when the belt 2 moves.

One prerequisite for exactly registering the material 3 in the printing position shown in FIG. 2, is that the direction of movement of the conveyor 2 shall coincide exactly with the center line of the conveyor belt, i.e. the belt must not be permitted to be laterally displaced.

To this end, the edge surface 2*a* of the conveyor belt 2 is provided with a plurality of guide means 25. These guide means are uniformly spaced along the conveyor belt 2 and are arranged to be guided by a bar 26 and a bar 27 fixed relative to the frame 1' of the printing machine.

FIG. 7 is a cross-sectional view of the edge 2*a* of the conveyor belt, and illustrates a slide plate 28 arranged on the upper side of the belt, said plate 28 being attached to the conveyor belt by means of a bolt 29. A counter plate 30 is urged against the belt 2*a* by the bolt 29 through its nut 31, while a plurality of ball-bearings 32, 32' are arranged to co-act with a sleeve 33 which, in turn, co-acts with the bolt 29.

As a result of this construction, the ball-bearings 32, 32' will roll against the bar or rail 27. Since two rails are provided, one on each side of the conveyor belt, and each of the guide means 25 is located on respective side of the conveyor belt, it will be obvious that the ball-bearings 32, 32' will extend the belt 2 through the rails 27 and guide displacement of the belt precisely without deviation from said center line.

For the purpose of estimating, with small tolerances, the distance moved by the material from the registering position shown in FIG. 1 to the printing position shown in FIG. 2, the movement of the conveyor belt 2 is detected, in accordance with the invention, by means of a detecting means 40. This detecting means 40 is arranged to co-operate with the belt 2 at a location somewhere between the registering position (FIG. 1) of the material and the printing position (FIG. 2). The detecting means comprise an optical shaft encoder, i.e. a device arranged to optically generate a coded output signal. This device may be of the kind sold by "Data Tecnology" Inc. Mass. USA under the designation OM25, and is constructed to produce 2500 pulses/revolution. Thus connected to the shaft 41 is a wheel 42 having a toothed or serrated peripheral surface 42*a*, the diameter of the wheel 42 being so selected that there is obtained on the line 43 a pulse for each small longitudinal section. In the illustrated case the diameter of the wheel has been selected so that each pulse corresponds to a belt distance of 0.1 mm. The line 43 is coupled to a counter 44 in the form of an "Electronic Digital Preset Counter" manufactured by (NLS) Non Linear System Corp. Calif. USA under number PR-S. The wheel 42 abuts the conveyor belt 2 and in this way measures the distance through which the material is carried by the belt, from the position shown in FIG. 1 to the position shown in FIG. 2. The line 43 is coupled to an electronic counter 44, arranged to count each small longitudinal section.

It is possible to set the counter to a pre-determined value, said value corresponding to the distance moved by the conveyor belt 2 from the first position shown in FIG. 1 to the second position shown in FIG. 2, and when the set value on the counter is reached, to generate an activating signal via a line 45. This activating signal is arranged to actuate the drive source, said source having the form of a direct current motor 46, and to stop the drive motor and the conveyor belt 2 when the material 3' has taken the second position shown in FIG. 2.

As previously mentioned, the material 3 shall be conveyed from the registered position shown in FIG. 1 to the printing position shown in FIG. 2 through a period of rapid acceleration, "a", a constant or substantially constant speed "b" and a rapid deceleration "c", and finally a period of very low speed "d", as shown in FIG. 10.

A coupling means 47 in the form of a square quadrant thyristor control, manufactured by GME-system AB, Stockholm, Sweden, designated TRDB-5, is arranged to control the drive source during the period of rapid acceleration, the constant or substantially constant speed and the rapid deceleration and the period of low speed. This tetraquadrant tyristor control may be arranged to drive a d.c. motor in any of two directions, by a sinus oscillation.

The counter 44 is arranged to control, via the signal on line 45, the thyristor control and the drive source 46 during the period of low speed, and to stop said drive source 46 as soon as the pre-determined value has been counted on the counter 44.

If it is assumed that the conveying distance is 1.26 meters, the counter is set to 12600. When starting the belt 2 in the position shown in FIG. 1, counting of the pulses is commenced. When the value 12585 is reached, guiding of the drive source 46 is taken over by the counter, which produces a stop pulse when the value 12600 is reached.

When the value 12585 is reached, the drive source shall advance the belt 2 very slowly.

Any delays between guide signal and stopping of the belt can be compensated by setting a lower value on the counter.

The drive source 46 is activated by a switch (not shown) and is arranged to drive a wheel 46*a* which is connected with the conveyor belt 22 in a manner known per se. This co-action is not illustrated in the accompaning drawings for reasons of clarity. The drive source 46 is activated for the period of rapid acceleration and the period of substantially constant velocity, and as soon as the wheel 46 has moved through the conveying distance "e" illustrated in FIG. 10, a switch 48 is activated, said activation being sent to the coupling means 47 via a line 49. The period of rapid deceleration is then coupled in and at a conveying time "f" the counter 46 guides the drive source 46 in the aforedescribed manner.

It should also be noted that at the time point "f", a hydraulic piston-cylinder arrangement 50 is activated, said arrangement being caused to co-act with a stop means 51 on a cam disc 52. The cam disc 52 is connected to the wheel 46*a* via a friction coupling not shown, which means that the cam disc 52 does not accompany rotation of the wheel 46*a* from the time "f" to the time "g". The aforementioned precise registering of the material in the position shown in FIG. 2 shall be effected between these time points. Essentially, this construction is intended to ensure that the printing machine deflects in the same position for each cycle, such that the period of acceleration constant velocity and rapid deceleration take place in such an order and over such period of time that the material is able to take the exact printing position during the period of low speed.

The arrangement of the cam disc 52, however, makes it possible to move the material very rapidly to a position immediately before the registering position, and for this to be repeated.

The principles, preferred embodiment and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

I claim:

1. A silk-screen printing machine, comprising drive means for driving a material-conveying means arranged to be stopped in a first position for registering material to be printed upon, and then to convey said material to a second, printing position in which a print corresponding to a stencil pattern is applied to said material, sensing means for sensing the movement of the material from said registering position to said printing position, said sensing means generating a pulse for displacements of the material of less than 0.5 mm, said sensing means is connected to a counter, said counter having means for generating a signal when a predetermined number of pulses corresponding to the conveyed distance between said first position and said second position is counted, the signal is adapted to actuate the drive means for stopping the conveying means when said material is in the second position, connecting means for controlling the drive means during a substantial portion of the transport of the material from the first to the second position over a period of rapid acceleration, substantially constant velocity and rapid deceleration, the counter controlling said drive means during the remaining small portion of the transport over a period of very low speed operation after the rapid deceleration and stopping said drive means.

2. A silk-screen printing machine according to claim 1, wherein said sensing means generates a pulse for displacements of the material of less than 0.1 mm.

3. A silk-screen printing machine according to claim 1, further comprising contacts acting upon a camshaft for controlling the drive means during the conveying of the material from registering position to printing position during the rapid acceleration to the rapid deceleration.

4. A silk-screen printing machine according to claim 3, further comprising disengagement means for disengaging said camshaft from the drive means during the very low speed operation of the drive means.

5. A silk-screen printing machine according to claim 1, wherein said drive means is a direct current motor controlled by a four-quadrant thyristor.

6. A silk-screen printing machine according to claim 5, wherein said movement sensing means is an optical pulse generator.

* * * * *